US011944201B1

(12) United States Patent
Susanto

(10) Patent No.: US 11,944,201 B1
(45) Date of Patent: Apr. 2, 2024

(54) MODULAR SOFA

(71) Applicant: Grafiti Home, Inc., Los Angeles, CA (US)

(72) Inventor: Billy Susanto, Los Angeles, CA (US)

(73) Assignee: Grafiti Home, Inc., Los Angeles, CA (US)

( * ) Notice: Subject to any disclaimer, the term of this patent is extended or adjusted under 35 U.S.C. 154(b) by 0 days.

(21) Appl. No.: 18/511,771

(22) Filed: Nov. 16, 2023

Related U.S. Application Data

(63) Continuation of application No. 18/132,266, filed on Apr. 7, 2023, now Pat. No. 11,849,851.

(51) Int. Cl.

| | |
|---|---|
| ***A47C 13/00*** | (2006.01) |
| ***A47C 4/02*** | (2006.01) |
| ***A47C 7/00*** | (2006.01) |
| ***A47C 7/42*** | (2006.01) |
| ***A47C 7/54*** | (2006.01) |

(Continued)

(52) U.S. Cl.

CPC ..... *A47C 13/005* (2013.01); *A47C 7/002* (2013.01); *A47C 7/42* (2013.01); *A47C 7/546* (2013.01); *A47C 17/04* (2013.01); *A47C 31/11* (2013.01); *A47C 4/02* (2013.01); *A47C 4/028* (2013.01)

(58) Field of Classification Search

CPC ..... A47C 13/005; A47C 7/002; A47C 7/42; A47C 7/546; A47C 17/04; A47C 31/11; A47C 4/02; A47C 4/028

USPC ..... 297/233, 440.14, 440.15, 440.2, 440.23, 297/451.8

See application file for complete search history.

(56) References Cited

U.S. PATENT DOCUMENTS

| | | |
|---|---|---|
| 3,669,494 A | 6/1972 | Lohmeyer |
| 4,077,666 A | 3/1978 | Heumann |

(Continued)

FOREIGN PATENT DOCUMENTS

| | | |
|---|---|---|
| DE | 1918540 | 10/1970 |
| JP | 2012223484 | 11/2012 |

(Continued)

OTHER PUBLICATIONS

Author Unknown, Sofa Dimensions, Bassettfurniture.com, Sep. 19, 2022, https://www.bassettfurniture.com/blog/depth-of-couch.aspx.

*Primary Examiner* — Robert Canfield
(74) *Attorney, Agent, or Firm* — Van Pelt, Yi & James LLP

(57) ABSTRACT

A modular furnishing may have a standard configuration and a deep seating configuration. The standard configuration includes a horizontally oriented rectangular base component and a first vertically oriented side component. The horizontally oriented rectangular base component has a front side, a left side, a right side, and a back side. The first vertically oriented side component is coupled to the back side of the horizontally oriented rectangular base component. A length of the first vertically oriented side component is longer than a length of the horizontally oriented rectangular base component. In the deep seating configuration, the first vertically oriented side component is configured to be coupled to the left side of the horizontally oriented rectangular base component, a left side of a base depth extension coupled to the back side of the horizontally oriented rectangular base component, and a left side of an additional vertically oriented component coupled to a back side of the base depth extension.

20 Claims, 5 Drawing Sheets

(51) Int. Cl.
*A47C 17/04* (2006.01)
*A47C 31/11* (2006.01)

(56) References Cited

U.S. PATENT DOCUMENTS

| | | | | |
|---|---|---|---|---|
| 7,213,885 | B2 | 5/2007 | White, III | |
| 11,297,949 | B1 | 4/2022 | Galjour | |
| 2004/0017101 | A1 | 1/2004 | Illulian | |
| 2011/0233976 | A1 | 9/2011 | Hanson | |
| 2011/0298340 | A1* | 12/2011 | Nelson | A47C 3/029 312/107 |
| 2014/0368010 | A1* | 12/2014 | Nelson | A47C 13/005 297/440.14 |
| 2016/0174715 | A1 | 6/2016 | Nelson | |
| 2016/0206100 | A1* | 7/2016 | Nelson | F16B 12/00 |
| 2020/0121090 | A1* | 4/2020 | Romano | A47C 17/86 |
| 2022/0000266 | A1* | 1/2022 | Nelson | A47C 13/005 |
| 2022/0354261 | A1 | 11/2022 | Aubé | |
| 2023/0067292 | A1 | 3/2023 | Altemimei | |

FOREIGN PATENT DOCUMENTS

| | | |
|---|---|---|
| JP | 2015123227 | 7/2015 |
| WO | 2015099161 | 7/2015 |

* cited by examiner

MODULAR SOFA

CROSS REFERENCE TO OTHER APPLICATIONS

This application is a continuation of U.S. patent application Ser. No. 18/132,266 entitled MODULAR SOFA filed Apr. 7, 2023, which is incorporated herein by reference for all purposes.

BACKGROUND OF THE INVENTION

A modular sofa is comprised of a plurality of different modules that may be arranged in a plurality of different configurations. A user may buy an initial set of modules to create a modular sofa for their current living space. At a later date, the user may decide to change the current modular sofa configuration. For example, the user may move to a different location. Instead of buying a new sofa to match the new living space at the different location, the user may buy an additional set of modules to expand the modular sofa or remove one or more of the existing modules to match the new living space. Modular sofas also enable a user to modify the sofa to suit their lifestyle. For example, a sectional sofa may be re-configured into a daybed when the user is having a "movie night." After the "movie night" is finished, the user may transform the daybed back into the sectional sofa.

BRIEF DESCRIPTION OF THE DRAWINGS

Various embodiments of the invention are disclosed in the following detailed description and the accompanying drawings.

DETAILED DESCRIPTION

The invention can be implemented in numerous ways, including as a process; an apparatus; a system; and/or a composition of matter. In this specification, these implementations, or any other form that the invention may take, may be referred to as techniques. In general, the order of the steps of disclosed processes may be altered within the scope of the invention.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

An initial module associated with a module sofa is comprised of base component and three side components. The base component is horizontally oriented and the three side components are vertically oriented. The base component and the three side components may be combined to generate a single-person chair. An additional module comprising of an additional base component and an additional side component may be added the initial module to generate a two-person sofa or a "love-seat." An additional module comprising another additional base component and another additional side component may be added to the two-person sofa to generate a three-person sofa.

Figure 1:
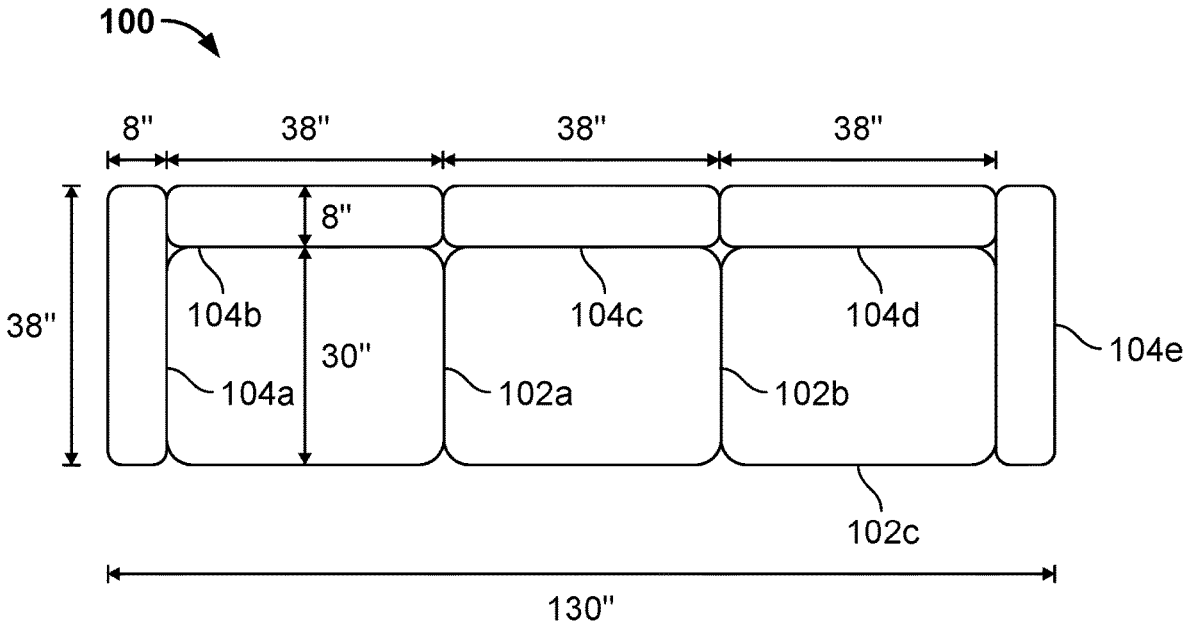
Prior Art FIG. 1
FIG. 1 illustrates an example of a modular sofa.

An example of a three-person modular sofa is depicted in FIG. 1. FIG. 1 provides a top-down view of modular sofa 100. In the example shown, modular sofa 100 includes three horizontally oriented base components 102*a*, 102*b*, 102*c* and five vertically oriented side components 104*a*, 104*b*, 104*c*, 104*d*, 104*e*. Side components 104*a*, 104*b*, 104*c*, 104*c*, 104*d*, 104*e* are interchangeable and may be used as either as a side component (e.g., an "arm rest") or as a back component for modular sofa 100. The base components and side components of a modular sofa have a particular spatial relationship that enables the modular sofa to be scaled up or down depending on the needs of a user. In the example shown, the base components 102*a*, 102*b*, 102*c* each have a length x (e.g., 38 inches) and a width y (e.g., 30 inches). Side components 104*a*, 104*b*, 104*c*, 104*d*, 104*e* each have a length x' (e.g., 38 inches) and a width y' (e.g., 8 inches). The length x of one of the base components 102*a*, 102*b*, 102*c* is substantially equal to the length x' of one of the side components 104*a*, 104*b*, 104*c*, 104*d*, 104*e* and the length x of one of the base components 102*a*, 102*b*, 102*c* is equal to the sum of the width y of one of the base components 102*a*, 102*b*, 102*c* and the width y' of one of the side components 104*a*, 104*b*, 104*c*, 104*d*, 104*e*.

Sofa depth is the measurement from the front of a sofa to the back of the sofa. The standard size of sofa depth is 38 inches. Typically, a deep seating sofa has a depth greater than 40 inches. This allows a person on the sofa lean back or lay down comfortably across it. Meanwhile, a shallow seat usually has a depth between 31 inches and 40 inches, which offers an upright seated position that puts a person's feet on the floor and supports the person's back.

Figure 2A:
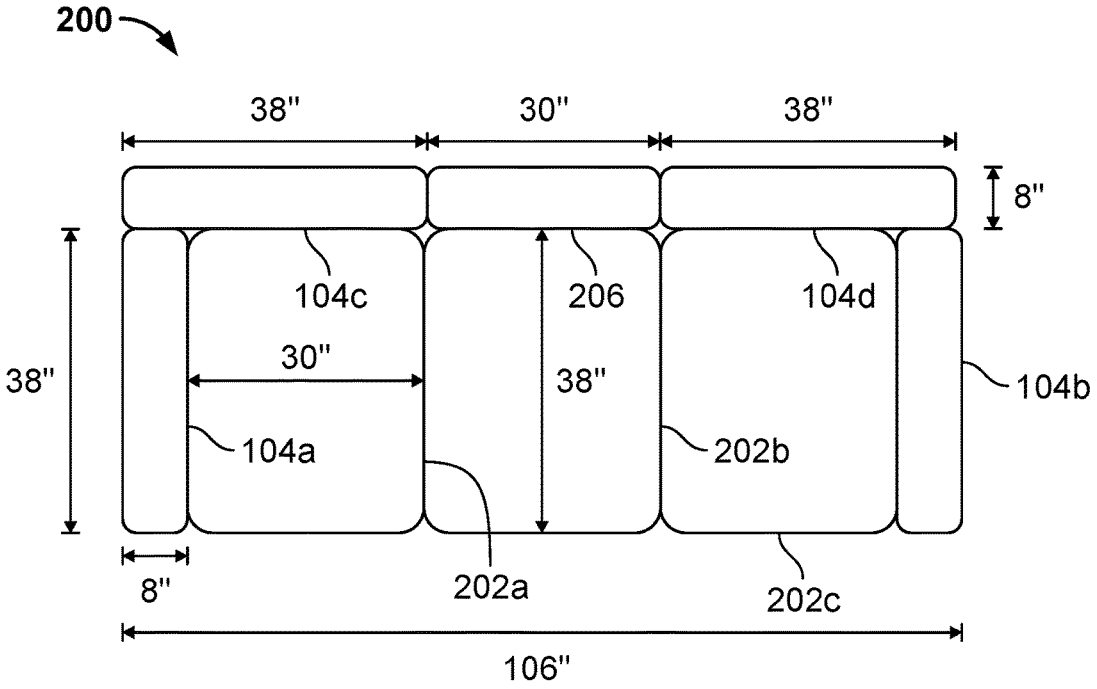
FIG. 2A illustrates an example of a modular sofa.

The components of a modular sofa 100 may be reconfigured to create a deep seating sofa. However, one limitation with modular sofa 100 is that due to its modular design, the spatial relationships between the base components 102*a*, 102*b*, 102*c* and side components 104*a*, 104*b*, 104*c*, 104*d*, 104*e* is fixed. Base components 102*a*, 102*b*, 102*c*, as seen in FIG. 2A, may be rotated 90° to become base components 202*a*, 202*b*, 202*c*. This results in a cushion width y of 38 inches, however, the cushion length x is merely 30 inches for base components 202*a*, 202*b*, 202*c*. Users of modular sofa 200 may feel that a 30 inch seat is too narrow and confining, especially when other users are concurrently using modular sofa 200.

Figure 2B:
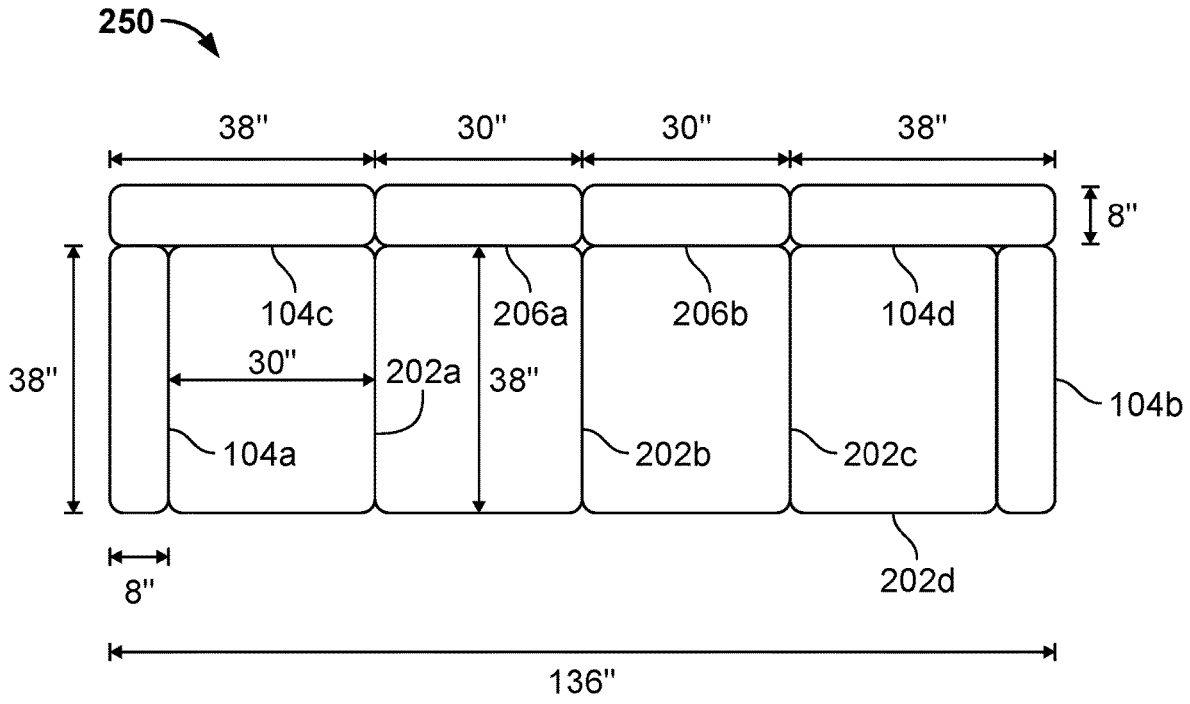
FIG. 2B illustrates an example of a modular sofa.

Furthermore, modular sofa 200 includes a back component 206 having a particular spatial relationship with base components 202*a*, 202*b*, 202*c*. The length of back component 206 (e.g., 30 inches) is equal to the length of one of the base components 202*a*, 202*b*, 202*c*. As a result, back component 206 must located between side components 104*c*, 104*d*. This places constraints on the modularity of modular sofa 200 because certain components must be located at certain positions. In contrast, as seen in FIG. 1, the position of side components 104*a*, 104*b*, 104*c*, 104*d*, 104*e* is interchangeable. This is further demonstrated in FIG. 2B. Modular sofa 200 has been expanded to become modular sofa 250 (e.g., a four person sofa) by adding base component 202*d*. Modular sofa 250 needs an additional back component 206*b* for base component 202*d*. As seen in FIG. 2B, back components 206*a*, 206*b* must be located between side components 104*c*, 104*d*.

Figure 3A:
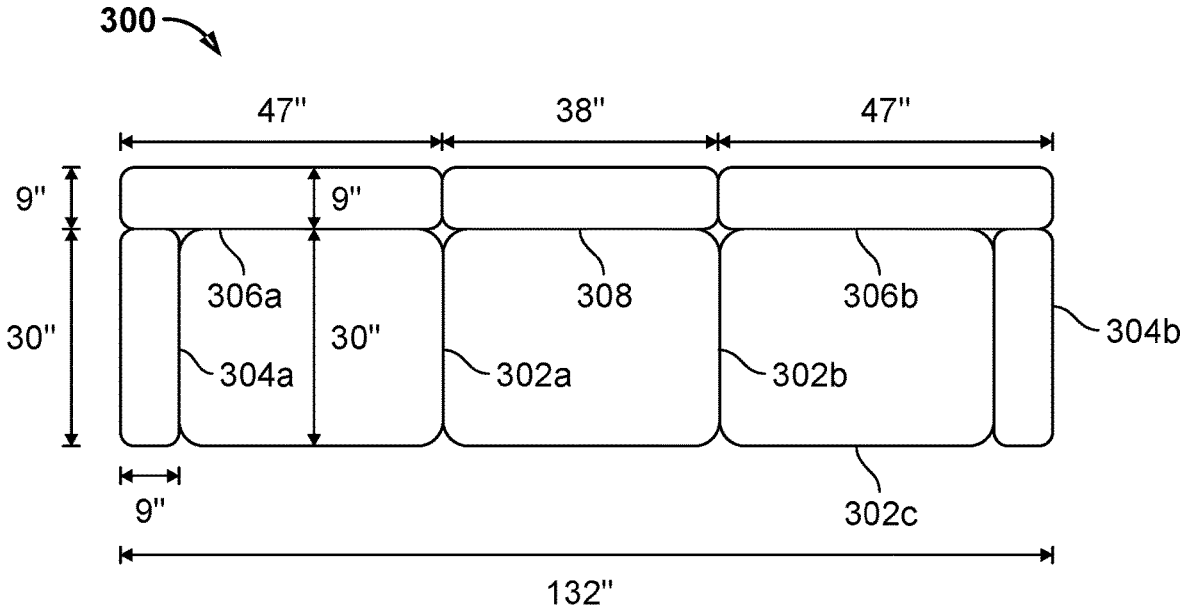
FIG. 3A illustrates a top-down view of a modular sofa in accordance with some embodiments.

A modular sofa that enables a user to switch between a sofa having standard size depth and a deep seating depth is disclosed. FIG. 3A illustrates a modular sofa in accordance with some embodiments. FIG. 3A provides a top-down view of modular sofa 300. In the example shown, modular sofa 300 includes three horizontally oriented base components 302*a*, 302*b*, 302*c*, two vertically oriented side components 304*a*, 304*b*, two vertically oriented side components 306*a*, 306*c*, and one vertically oriented side component 308. Base components 302*a*, 302*b* and side components 304*a*, 304*b* have a particular spatial relationship. In the example shown, the base components 302*a*, 302*b*, 302*c* each have a length x (e.g., 38 inches) and a width y (e.g., 30 inches). Side components 304*a*, 304*b* each have a length x' (e.g., 30 inches) and a width y' (e.g., 9 inches). The height of base components 302*a*, 302*b*, 302*c* (e.g., 11 inches) is substantially equal to each other. The design for a component of modular sofa may specify the component to have particular dimensions. The physical manufacture of that component may be within a manufacturing threshold of the design. The height of base components 302*a*, 302*b*, 302*c* is substantially equal to each other if they are within a manufacturing threshold of each other (e.g., ±0.25 inches). The length x of one of the base components 302*a*, 302*b* (e.g., 38 inches) is greater than the width of one of the side components 304*a*, 304*b* (e.g., 30 inches) and the length x (e.g., 30 inches) is less than a sum of the width y of one of the base components 302*a*, 302*b* (e.g., 30 inches) and the width y' of one of the side components 304*a*, 304*b* (e.g., 9 inches). The height of side components 304*a*, 304*b* (e.g., 24 inches) is substantially equal to each other (e.g., within a manufacturing threshold). The height of each of the base components 302*a*, 302*b*, 302*c* is less than the height of each of the side components 304*a*, 304*b*.

The side components 306*a*, 306*b* each have a length x" (e.g., 47 inches) and a width y" (e.g., 9 inches). The length x" of one of the side components 306*a*, 306*b* (e.g., 47 inches) is substantially equal (e.g., within a manufacturing threshold) to the sum of the width y of one of the base components 302*a*, 302*b*, 302*c* (e.g., 38 inches) and the width y" of one of the side components 304*a*, 304*b* (e.g., 9 inches). The height of side components 306*a*, 306*b* (e.g., 24 inches) is substantially equal to each other (e.g., within a manufacturing threshold).

The side component 308 has a length x''' (e.g., 38 inches) and a width y''' (e.g., 9 inches. The length x''' of the side component 308 (e.g., 38 inches) is substantially equal (e.g., within a manufacturing threshold) to the sum of the length x of one of the base components 302*a*, 302*b*, 302*c* (e.g., 38 inches) (e.g., within a manufacturing threshold). The width y''' of the side component 308 (e.g., 9 inches) is substantially equal (e.g., within a manufacturing threshold) to the width y" of the side components 304*a*, 304*b* (e.g., 9 inches). The height of side component 308 (e.g., 24 inches) is substantially equal (e.g., within a manufacturing threshold) to the height of side components 306*a*, 306*b* and side components 304*a*, 304*b*.

The height of side component 308 is substantially equal (e.g., within a manufacturing threshold) to the height of side component 306*a* or side component 306*b* (e.g., within a manufacturing threshold). The height of side component 308 and side components 306*a*, 306*b* is greater than the height of side components 304*a*, 304*b* and the height of base components 302*a*, 302*b*, 302*c*. The height of side components 304*a*, 304*b* is greater than the height of base components 302*a*, 302*b*, 302*c*.

Figure 3B:
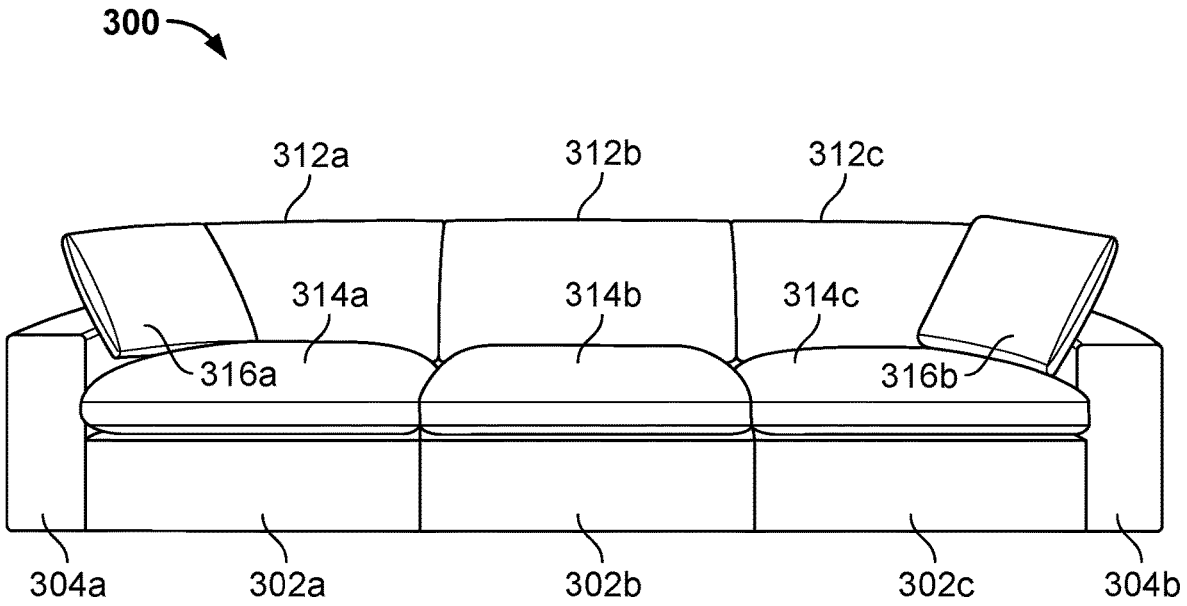
FIG. 3B illustrates a front view of a modular sofa in accordance with some embodiments.

A front view of modular sofa 300 is illustrated in FIG. 3B, which depicts modular sofa 300 including base components 302*a*, 302*b*, 302 and side components 304*a*, 304*b*. Modular sofa 300 also includes base cushions 314*a*, 314*b*, 314*c*, back cushions 312*a*, 312*b*, 312*c*. Modular sofa 300 may also include pillows 316*a*, 316*b*.

Modular sofa 300 may be modified to become a four person sofa, a five person couch, . . . , etc. by adding one or more additional base components (e.g., base component 302*a*) and one or more additional side components 308.

The particular spatial relationship between the base components 302*a*, 302*b*, 302*c*, the side components, 304*a*, 304*b*, and the side component 308 may be reused and reconfigured, enabling modular sofa 300 to become a deep seating sofa.

Figure 4A:
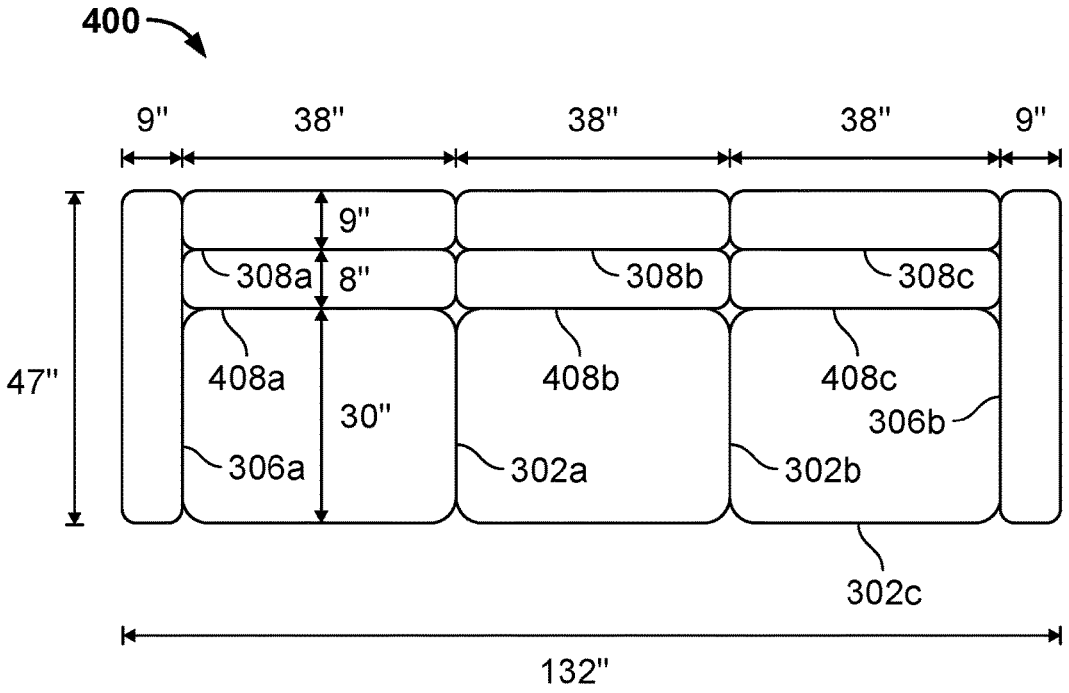
FIG. 4A illustrates a top-down view of a modular sofa in accordance with some embodiments.

FIG. 4A illustrates a deep seating modular sofa in accordance with some embodiments. In the example shown, deep seating modular sofa 400 includes horizontally oriented base components 302*a*, 302*b*, 302*c*. A location of vertically oriented side components 306*a*, 306*b* have been modified from a back position of modular sofa 300 to a side position of modular sofa 400. A portion of side components 306*a*, 306*b* are used as arm rests for users of modular sofa 400. The back portion of modular sofa 400 is comprised of three versions of side component 308, shown as side components 308*a*, 308*b*, 308*c*.

Modular sofa 300 may be reconfigured into a deep seating sofa by adding base depth extensions 408*a*, 408*b*, 408*c* in between side components 308*a*, 308*b*, 308*c* and base components 302*a*, 302*b*, 302*c*. A base depth extension has a front surface that is coupled to one of the base components 302*a*, 302*b*, 302*c* and a back surface that is coupled to one of the side components 308*a*, 308*b*, 308*c*. The front surface of the base depth extension is substantially parallel to the back surface of the base depth extension (e.g., within a threshold number of degrees).

Base depth extensions 408*a*, 408*b*, 408*c* each have a length of x'''' (e.g., 38 inches) and a width of y'''' (e.g., 8 inches). Base depth extensions 408*a*, 408*b*, 408*c* each have a length x'''' that is substantially equal (e.g., within a manufacturing threshold) to the length x of one of the base components 302*a*, 302*b*, 302*c* and substantially equal (e.g., within a manufacturing threshold) to the length x''' of one of the side components 308*a*, 308*b*, 308*c*. A length x" of one of the side components 306*a*, 306*b* is substantially equal (e.g., within a manufacturing threshold) to sum of the width y of one of the base components 302*a*, 302*b*, 302*c*, the width y'''' of one of the base depth extensions 408*a*, 408*b*, 408*c*, and the width y''' of one of the side components 308*a*, 308*b*, 308*c*. In some embodiments, the width of a base depth extension is substantially equal (e.g., within a manufacturing threshold) to the width of one of the side components 308*a*, 308*b*, 308*c*.

Modular sofa 400 may be expanded to include additional seating. Unlike modular sofa 250, the additional base component and base depth extension is not tied to a specific location and may be located anywhere in between side components 306*a*, 306*b*.

Figure 4B:
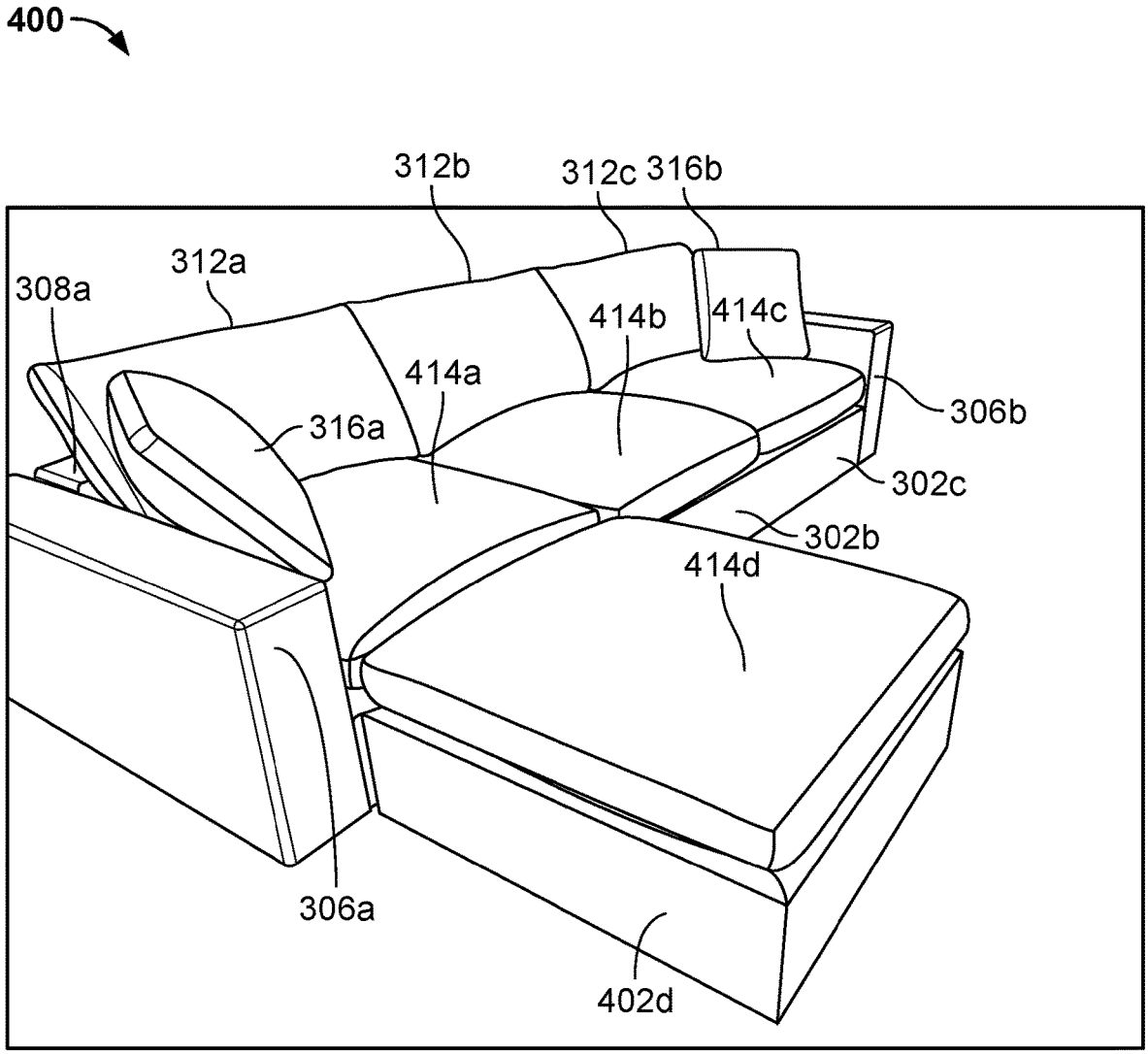
FIG. 4B illustrates a perspective view of a modular sofa in accordance with some embodiments.

FIG. 4B illustrates a perspective view of a modular sofa in accordance with some embodiments. A seat cushion for deep seating modular sofa 400 needs to cover a base component and a corresponding base depth extension. In the example shown, deep seating modular sofa 400 includes cushions 414*a*, 414*b*, 414*c*. A seat cushion for modular sofa 400 has a length that is substantially equal (e.g., within a manufacturing threshold) to the length of a base component and a width that is substantially equal (e.g., within a manufacturing threshold) to the sum of the width of a base component and the width of a base depth extension. Seat cushions 414*a*, 414*b*, 414*c* are square seat cushions whereas seat cushions 314*a*, 314*b*, 314*c* are rectangular seat cushions. Deep seating modular sofa 400 also includes back cushions 312*a*, 312*b*, 312*c*. Deep seating modular sofa 400 may include pillows 316*a*, 316*b*.

In some embodiments, deep seating modular sofa 400 includes base component 402*d* and cushion 414*d*. In some embodiments, the combination of base component 402*d* and cushion 414*d* is used as part of a chaise for deep seating modular sofa 400. In some embodiments, the combination of base component 402*d* and cushion 414*d* is used as an ottoman.

Figure 4C:
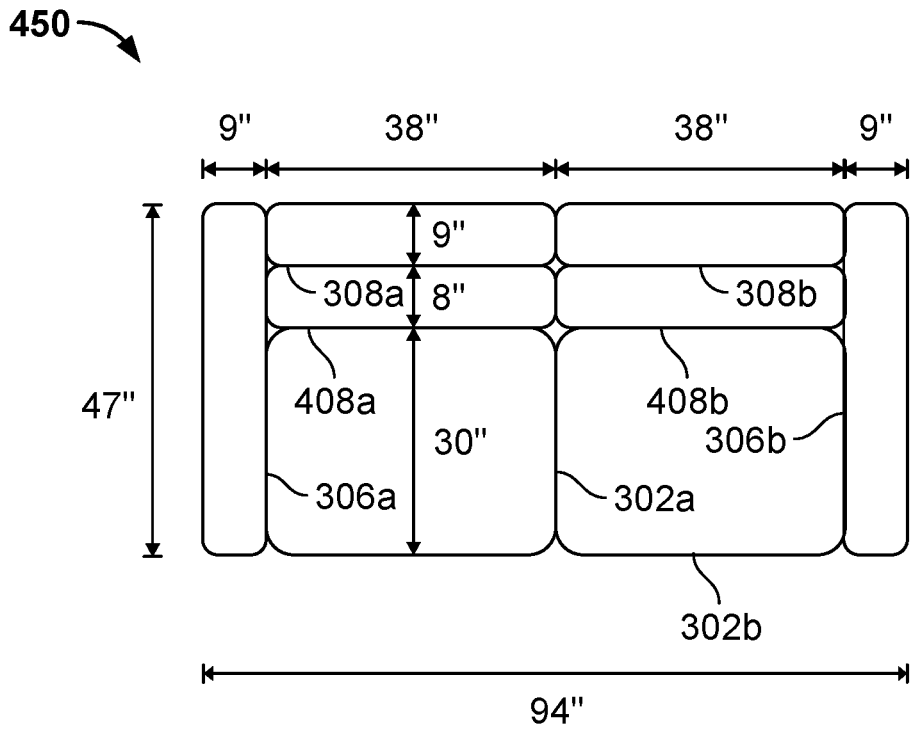
FIG. 4C illustrates a top-down view of a modular sofa in accordance with some embodiments.

FIG. 4C illustrates a top-down view of a modular sofa in accordance with some embodiments. In the example shown, deep seating modular sofa 450 includes horizontally oriented base components 302*a*, 302*b*. A location of vertically oriented side components 306*a*, 306*b* have been modified from a back position of modular sofa 300 to a side position of modular sofa 450. A portion of side components 306*a*, 306*b* are used as arm rests for users of modular sofa 450. The back portion of modular sofa 450 is comprised of two versions of side component 308, shown as side components 308*a*, 308*b*.

Figure 5:
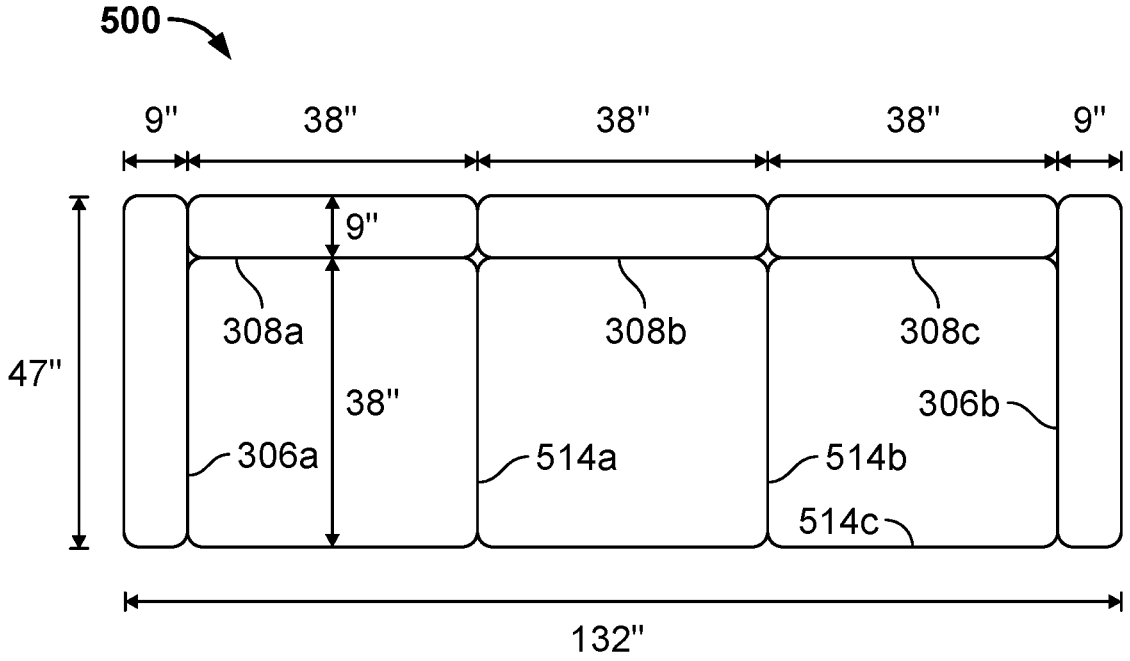
FIG. 5 illustrates a top-down view of a modular sofa in accordance with some embodiments.

FIG. 5 illustrates a top-down view of a modular sofa in accordance with some embodiments. A cover for deep seating modular sofa 500 needs to cover a base component and a corresponding base depth extension. In the example shown, deep seating modular sofa 500 includes covers 514*a*, 514*b*, 514*c*. A cover for modular sofa 500 has a length that is substantially equal (e.g., within a manufacturing threshold) to the length of a base component and a width that is substantially equal (e.g., within a manufacturing threshold) to the sum of the width of a base component and the width of a base depth extension.

A transporter of a modular sofa may place constraints on a dimensional weight associated with a component. For example, the transporter may charge a first amount if a dimensional weight associated with the component are less than or equal to a threshold dimensional weight and a second amount if the contents are greater than the threshold dimensional weight where the second amount is greater than the first amount. In some embodiments, the dimensional weight is equal to the length of a component+2*(width of the component+height of the component). In some embodiments, the threshold dimensional weight 130 inches. The dimensions of a component associated with modular sofas 300, 400 may be designed to be less than or equal to the threshold dimensional weight to prevent the transporter charging the second amount.

Users of deep seating modular sofa 400, when compared to the modular sofas 200, 250, may feel that it is more comfortable and less confining to use because the seat length of base components 302*a*, 302*b*, 302*c* is greater than the seat lengths of base components 202*a*, 202*b*, 202*c*.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A modular furnishing having a standard configuration and a deep seating configuration, the standard configuration comprising:

a horizontally oriented rectangular base component having a front side, a left side, a right side, and a back side; and a first vertically oriented side component coupled to the back side of the horizontally oriented rectangular base component, wherein a length of the first vertically oriented side component is longer than a length of the horizontally oriented rectangular base component, and wherein in the deep seating configuration, the first vertically oriented side component is configured to be coupled to the left side of the horizontally oriented rectangular base component, a left side of a base depth extension coupled to the back side of the horizontally oriented rectangular base component, and a left side of an additional vertically oriented component coupled to a back side of the base depth extension.

2. The modular furnishing of claim 1, wherein the standard configuration further comprises a second vertically oriented side component coupled to the left side of the horizontally oriented rectangular base component and a portion of a front side of the first vertically oriented side component.

3. The modular furnishing of claim 2, wherein a width of the horizontally oriented rectangular base component is substantially equal to a length of the second vertically oriented side component.

4. The modular furnishing of claim 2, wherein a width of the first vertically oriented side component is substantially equal to a width of the second vertically oriented side component.

5. The modular furnishing of claim 2, wherein the length of the first vertically oriented side component is greater than a length of the second vertically oriented side component.

6. The modular furnishing of claim 2, wherein a length of the horizontally oriented rectangular base component is less than a sum of a width of the horizontally oriented rectangular base component and a width of the second vertically oriented side component.

7. The modular furnishing of claim 2, wherein a height of the horizontally oriented rectangular base component is less than a height of the second vertically oriented side component.

8. The modular furnishing of claim 2, wherein the length of the first vertically oriented side component is substantially equal to a sum of a width of the second vertically oriented side component and the length of the horizontally oriented rectangular base component.

9. The modular furnishing of claim 2, wherein the standard configuration further comprises:

a second horizontally oriented rectangular base component coupled to the right side of the horizontally oriented rectangular base component;

a third horizontally oriented rectangular base component coupled to a right side of the second horizontally oriented rectangular base component;

a third vertically oriented side component coupled to a right side of the first vertically oriented side component;

a fourth vertically oriented side component coupled to a right side of the third vertically oriented side component; and a fifth vertically oriented side component coupled to a right side of the third horizontally oriented rectangular base component and a portion of a front side of the fourth vertically oriented side component.

10. The modular furnishing of claim 9, wherein the length of the horizontally oriented rectangular base component is substantially equal to a length of second horizontally oriented rectangular base component and a length of the third horizontally oriented rectangular base component.

11. The modular furnishing of claim 9, wherein a width of the horizontally oriented rectangular base component is substantially equal to a width of second horizontally oriented rectangular base component and a width of the third horizontally oriented rectangular base component.

12. The modular furnishing of claim 9, wherein a length of the first vertically oriented side component is substantially equal to a length of the fourth vertically oriented side component.

13. The modular furnishing of claim 12, wherein a length of the third vertically oriented side component is less than the length of the first vertically oriented side component.

14. The modular furnishing of claim 13, wherein the length of the third vertically oriented side component is substantially equal to the length of the horizontally oriented rectangular base component.

15. The modular furnishing of claim 9, wherein a length of the second vertically oriented side component is substantially equal to a length of the fifth vertically oriented side component.

16. The modular furnishing of claim 9, wherein a height of the first vertically oriented side component is substantially equal to a height of the third vertically oriented side component.

17. The modular furnishing of claim 9, wherein a height of the first vertically oriented side component is substantially equal to a height of the fourth vertically oriented side component.

18. The modular furnishing of claim 9, wherein a width of the first vertically oriented side component is substantially equal to a width of the third vertically oriented side component.

19. The modular furnishing of claim 9, wherein a width of the first vertically oriented side component is substantially equal to a width of the fourth vertically oriented side component.

20. The modular furnishing of claim 1, wherein a length of the additional vertically oriented component is substantially equal to a length of the horizontally oriented rectangular base component.

* * * * *